US006712646B2

(12) United States Patent
Shindo

(10) Patent No.: US 6,712,646 B2
(45) Date of Patent: Mar. 30, 2004

(54) HIGH-SPEED TRANSMISSION CONNECTOR WITH A GROUND STRUCTURE HAVING AN IMPROVED SHIELDING FUNCTION

(75) Inventor: Takeshi Shindo, Akishima (JP)

(73) Assignee: Japan Aviation Electronics Industry, Limited, Tokyo (JP)

( * ) Notice: Subject to any disclaimer, the term of this patent is extended or adjusted under 35 U.S.C. 154(b) by 0 days.

(21) Appl. No.: 09/991,148

(22) Filed: Nov. 19, 2001

(65) Prior Publication Data

US 2002/0048995 A1 Apr. 25, 2002

(30) Foreign Application Priority Data

Oct. 20, 2000 (JP) ..... 2000-321255
Sep. 17, 2001 (JP) ..... 2001-281731

(51) Int. Cl.[7] ..... H01R 13/648
(52) U.S. Cl. ..... 439/608; 439/101; 439/108
(58) Field of Search ..... 439/609, 607, 439/608, 108, 101

(56) References Cited

U.S. PATENT DOCUMENTS

| | | | | |
|---|---|---|---|---|
| 6,379,188 B1 | | 4/1930 | Cohen et al. | 439/608 |
| 5,046,960 A | | 9/1991 | Fedder | 439/608 |
| 5,429,520 A | | 7/1995 | Morlion et al. | 439/608 |
| 5,993,259 A | * | 11/1999 | Stokoe et al. | 439/608 |
| 6,231,391 B1 | | 5/2001 | Ramey et al. | 439/608 |

FOREIGN PATENT DOCUMENTS

| | | |
|---|---|---|
| JP | 62-88383 | 6/1987 |
| JP | 1-286274 | 11/1989 |
| JP | 2-256184 | 10/1990 |
| JP | 3-233879 | 10/1991 |
| JP | 4-181668 | 6/1992 |
| JP | 5-62984 | 8/1993 |
| JP | 5-73881 | 10/1993 |
| JP | 5-275139 | 10/1993 |
| JP | 7-8963 | 2/1995 |
| JP | 3011823 | 3/1995 |
| JP | 7-114952 | 5/1995 |
| JP | 3-142124 | 6/1995 |
| JP | 9-167661 | 6/1997 |

* cited by examiner

*Primary Examiner*—P. Austin Bradley
*Assistant Examiner*—Briggitte R. Hammond
(74) *Attorney, Agent, or Firm*—Michael Best & Friedrich LLP

(57) ABSTRACT

A connector (1, 11) comprises a connector housing (2, 12), a plurality of signaling contacts (3, 13) arranged in a plurality of columns and a plurality of rows, a plurality of first ground plates (4, 16) arranged between every two adjacent ones of and at the outside of opposite outermost ones of the columns, and a plurality of second ground plates (5, 17) arranged between every two adjacent ones of and at the outside of opposite outermost ones of the rows. The first and the second ground plates (4, 5; 6, 17) are connected to each other to form a grid structure to enclose each individual contact in each grid cell. In case of differential signal transmission, each pair of two contacts is enclosed in each grid cell.

23 Claims, 13 Drawing Sheets

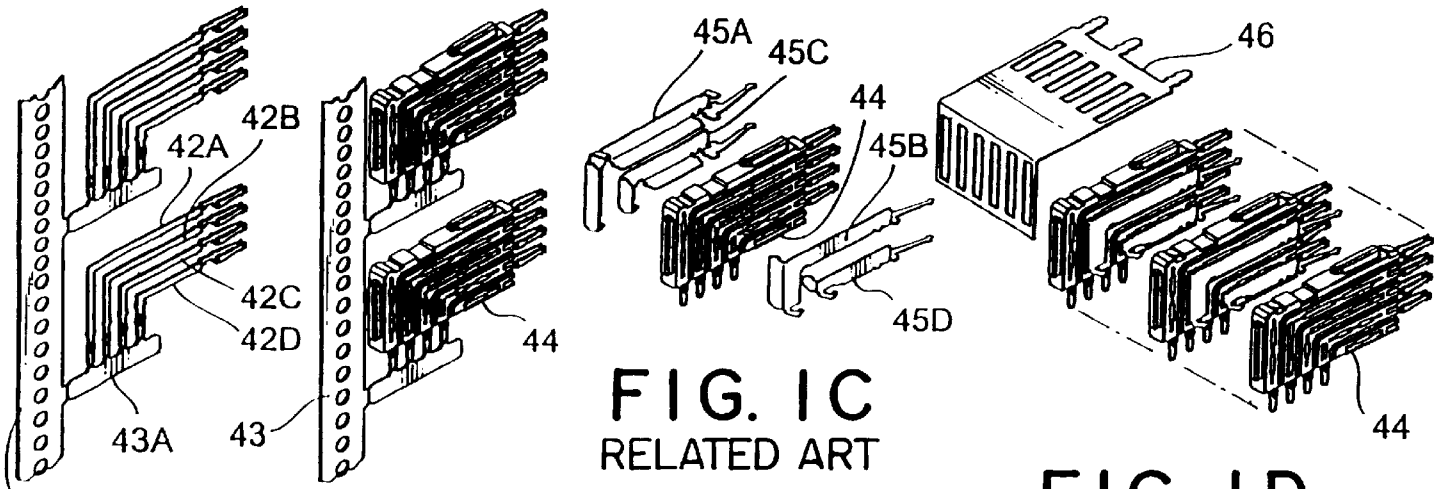
FIG. 1A
RELATED ART
FIG. 1B
RELATED ART
FIG. 1C
RELATED ART
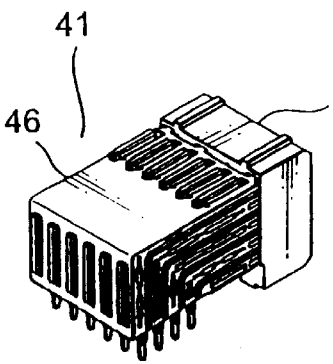
FIG. 1D
RELATED ART
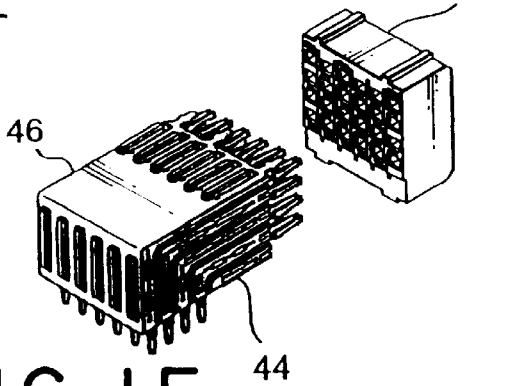
FIG. 1E
RELATED ART
FIG. 1F
RELATED ART

HIGH-SPEED TRANSMISSION CONNECTOR WITH A GROUND STRUCTURE HAVING AN IMPROVED SHIELDING FUNCTION

BACKGROUND OF THE INVENTION

This invention relates to a high-speed transmission connector and, in particular, to a ground structure of the high-speed transmission connector.

An electrical connector is used to connect two electrical apparatuses. Particularly when a signal is transmitted at a high speed, shielding is required for preventing leakage of the signal and entrance of noise. In case of a connector for connecting two circuit boards to each other, a simple ground structure as a shield is important.

Referring to FIGS. 1A through 1F, description will be made of an assembling process of an existing high-speed transmission connector having a shielding ground structure. In the illustrated example, the high-speed transmission connector is a plug connector having socket contacts for transmitting signals therethrough, which will be referred to as signal socket contacts.

At first referring to FIG. 1A, a plurality of sets of four signal socket contacts 42A through 42D for use in the plug connector (41 in FIG. 1F) are connected to a plurality of arms 43A protruding from a carrier 43, respectively. Each of the signal socket contacts 42A through 42D has a substantially L shape. Such a plurality of sets of the signal socket contacts 42A through 42D connected to the carrier 43 are prepared by pressing a single metal plate.

Next referring to FIG. 1B, the signal socket contacts 42A through 42D in each set are subjected to insert-molding by the use of an insulating resin material to form a contact module 44.

Subsequently, the signal socket contacts 42A through 42D in each contact module 44 are separated from the arm 43A of the carrier 43. As illustrated in FIG. 1C, four ground plates 45A through 45D are incorporated into the contact module 44 on opposite sides thereof, two on one side and two on the other side. Specifically, the ground plates 45A through 45D are press-fitted into grooves formed in the contact module 44. The ground plates 45A through 45D correspond to the signal socket contacts 42A through 42D, respectively. The ground plates 45A through 45D are alternately arranged on the opposite sides of the contact module 44. Specifically, the ground plates 45A and 45C corresponding to the signal socket contacts 42A and 42C are arranged on one side of the contact module 44 while the ground plates 45B and 45D corresponding to the signal socket contacts 42B and 42D are arranged on the other side of the contact module 44.

Turning to FIG. 1D, a shield plate 46 bent into a generally L shape is prepared. Into the shield plate 46, the contact modules 44 with the ground plates 45A through 45D incorporated therein are provisionally inserted one by one. After the contact modules 44, six in total, are inserted, they are collectively press fitted. Then, an assembly illustrated on a left-hand side in FIG. 1E is obtained.

Finally, the assembly including the six contact modules 44 and the shield plate 46 are press fitted into a housing 47 to complete the socket connector 41 as illustrated in FIG. 1F.

Thus, the socket connector 41 includes the six sets of the signal socket contacts 42A through 42D as the six contact modules 44. Among the six sets of the signal socket contacts 42A through 42D, the four sets located inside are shielded by the ground plates on both of the left and the right sides. However, the signal socket contacts 42B and 42D of the leftmost set are not shielded on the left side by the ground plates. Likewise, the signal socket contacts 42A and 42C of the rightmost set are not shielded on the right side by the ground plates. Therefore, the leftmost and the rightmost sets are not practically used.

SUMMARY OF THE INVENTION

It is therefore an object of this invention to provide a high-speed transmission connector in which all of signaling contacts including outermost ones are shielded by grounding plates so as to reliably transmit a high-speed signal.

According to this invention, the following structures are provided:

1. A high-speed transmission connector comprising an insulating connector housing, a plurality of contacts fixed to the connector housing at positions forming a plurality of rows and a plurality of columns in a matrix arrangement, and a shield attached to the connector housing, wherein:
   - the shield comprises a plurality of first ground plates extending in parallel to the columns of the contacts and a plurality of second ground plates extending in parallel to the rows of the contacts;
   - at least either one ground plates of the first ground plates and the second ground plates being provided with contacting portions to be connected to the other ground plates, one of each of the first ground plates and each of the second ground plates having at least one ground terminal to be connected to an external circuit;
   - the first ground plates being arranged at an outside of opposite outermost ones of and between every two adjacent ones of the columns of the contacts, the second ground plates being arranged at an outside of opposite outermost ones of and between every two adjacent one of the rows of the contacts, the first and the second ground plates surrounding the contacts and forming a grid structure.
2. A board connector to be mounted on a circuit board, the connector being a high-speed transmission connector for use in connecting a signal circuit of a differential signal transmission system in which a single differential signal is transmitted through each air of two adjacent ones of a plurality of contacts, the connector comprising:
   - an insulating connector housing provided with a plurality of contact holding holes arranged in a matrix fashion to form a plurality of columns and a plurality of rows including two upper rows and two lower rows, a plurality of first slits formed between every two adjacent ones of and at the outside of opposite outermost ones of the columns of the holding holes and extending in parallel to the columns, and a second slit formed between the two upper rows and the two lower rows of the holding holes and extending in parallel to the rows;
   - a plurality of contacts fixed to the contact holding holes, respectively;
   - a plurality of ground plates inserted into the first slits, respectively; and
   - a second ground plate inserted into the second slit and brought into contact with the first ground plates.

Each of the contacts has a contact lead terminal to be connected to a circuit pattern on the circuit board. Each of the first ground plates has first, second, and third ground terminals which are to be connected to a ground pattern of the circuit board. The contact lead terminals are arranged to form a plurality of columns and plurality of rows in a matrix arrangement. The first, the second, and the third ground terminals are arranged at the outside of opposite outermost ones of and between every two adjacent ones of the columns of the contact lead terminals in a direction parallel to the columns. The first ground terminals of the first ground plates are arranged at the outside of the first row of the contact lead terminals in parallel to the first row. The second ground terminals are arranged between the second and the third rows of the contact lead terminals in parallel to the second and the third rows. The third ground terminals are arranged at the outside of the fourth row of the contact lead terminals in parallel to the fourth row.

3. A high-speed transmission connector for use in connecting a signal circuit of a differential signal transmission system in which a single differential signal is transmitted through each pair of two adjacent ones of a plurality of contacts. The connector comprises:

an insulating connector housing having a plurality of contact holding holes arranged in a matrix fashion to form a plurality of columns and a plurality of rows including two upper rows and two lower rows. A plurality of first slits are formed between every two adjacent ones of and at the outside of opposite outermost ones of the columns of the holding holes and extending in parallel to the columns. A second slit is formed between the two upper rows and the two lower rows of the holding holes and extending in parallel to the rows.

A plurality of contacts are fixed to the contact holding holes, respectively.

A plurality of first ground plates are inserted into the first slits, respectively.

A second ground plate is inserted into the second slit and brought into contact with the first ground plates.

Each of third ground terminals of the second ground plate has a pair of wing portions formed at its base to protrude towards adjacent columns of the contact lead terminals on opposite sides. Each of the contact lead terminals of the contacts and the ground terminals of the first ground plates is formed into a press-fit portion. Each of the first ground plates is integrally coupled with an insulator by press-fitting or insert-molding to form a ground plate module. The ground plate modules are inserted into the connector housing at the outside of the opposite outermost ones of and between every two adjacent ones of the columns of the contacts. The connector is attached to the circuit board by incorporating the ground plate modules into the connector housing in a state when lower ends of the insulators of the ground plate modules are brought into contact with upper ends of the wing portions and then pressing the ground plate modules to the circuit board.

BRIEF DESCRIPTION OF THE DRAWING

FIGS. 1A through 1F are perspective views showing an assembling process of a socket connector as an existing high-speed transmission connector;

DESCRIPTION OF THE PREFERRED EMBODIMENTS

Figure 2A:
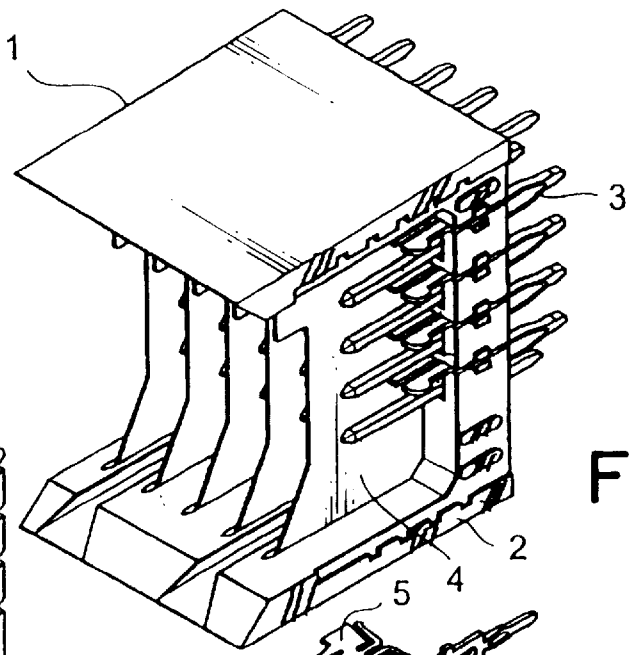
FIGS. 2A and 2B are perspective views of a receptacle connector and a plug connector as high-speed transmission connectors according to a first embodiment of this invention, respectively.
Figure 2C:
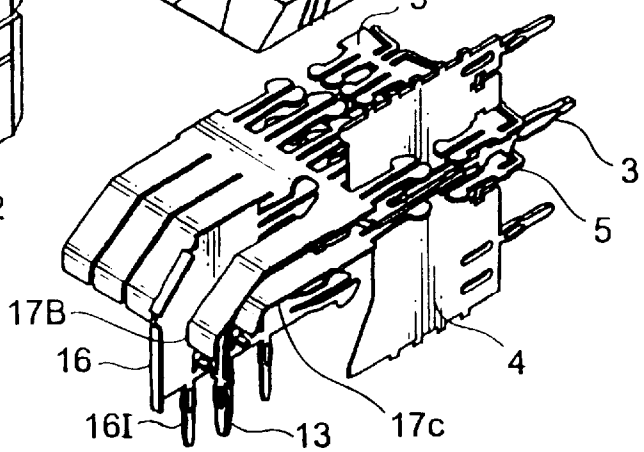
FIG. 2C is a perspective view showing contacts and a ground plate when the receptacle connector in FIG. 2A and the plug connector in FIG. 2B are fitted to each other.
Figure 2B:
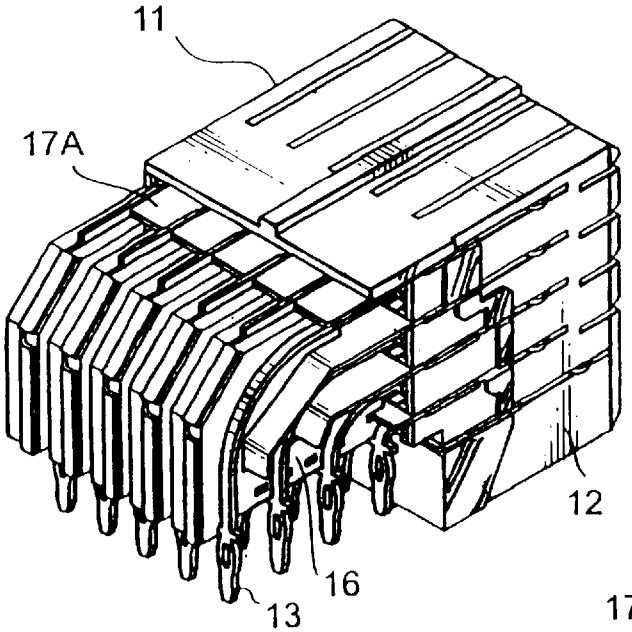

Now, description will be made of a high-speed transmission connector according to this invention in conjunction with several preferred embodiments of this invention with reference to the drawing.

At first referring to FIGS. 2A to 2C, 3, and 4A to 4C, description will be made of a receptacle connector 1 and a plug connector 11 as high-speed transmission connectors to be fitted or connected to each other.

Referring to FIGS. 2A–2C and 3, the receptacle connector 1 comprises an insulating receptacle housing 2 having a generally U-shaped section, a plurality of signal pin contacts 3 for transmitting signals held by the receptacle housing 2 and arranged in a matrix fashion, a plurality of first ground plates 4 extending in a first direction or a column direction, and a plurality of second ground plates 5 extending in a second direction or a row direction perpendicular to the column direction. More in detail, the pin contacts 3, twenty in number, are arranged in five columns and four rows. In other words, four pin contacts are arranged in each of the columns while five pin contacts are arranged in each of the rows. The first ground plates 4, six in number, are arranged between every two adjacent ones of and at the outside of opposite outermost ones of the columns of the pin contacts 3. The second ground plates 5, five in number, are arranged between every two adjacent ones of and at the outside of opposite outermost ones of the rows of the pin contacts 3.

Figure 3:
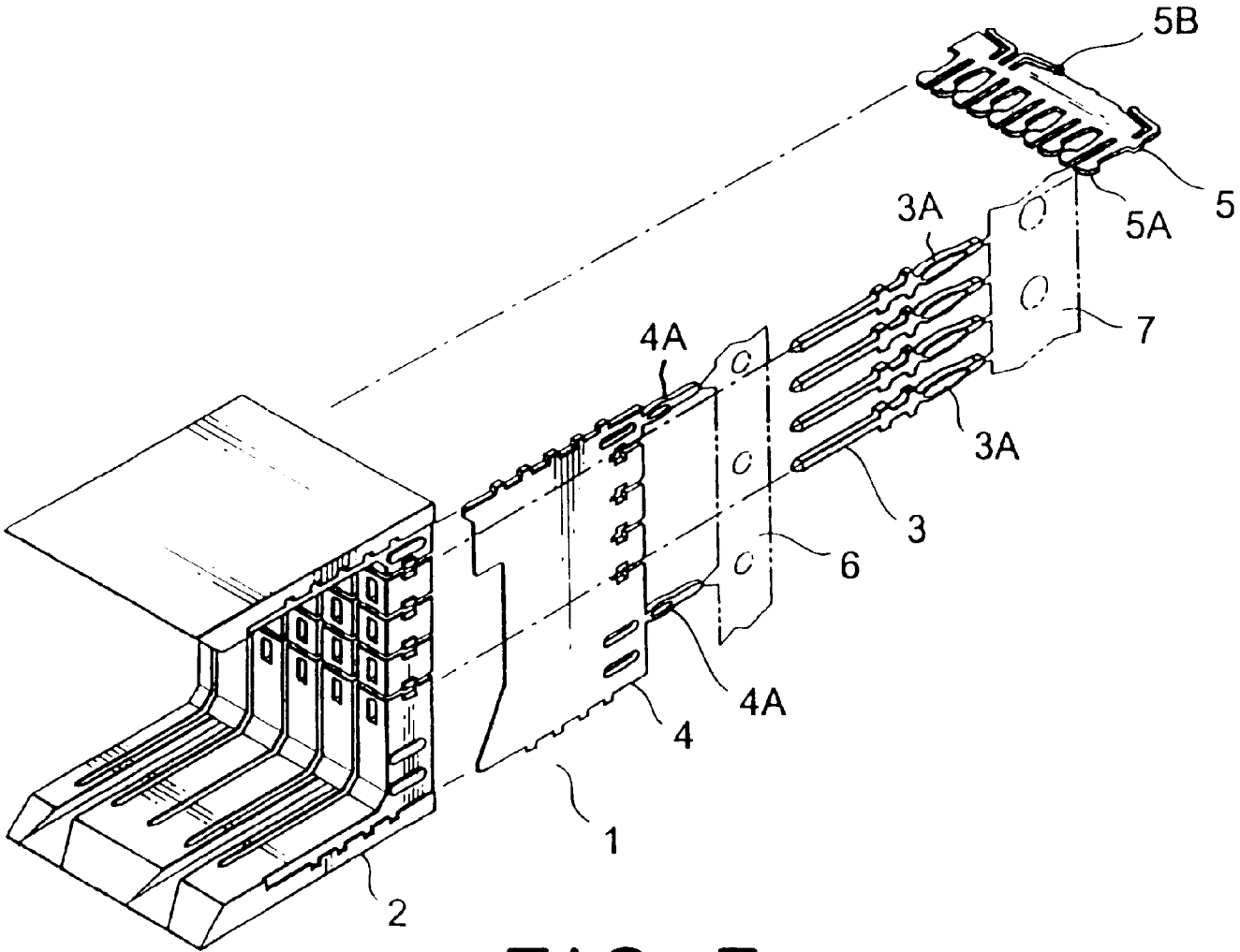
FIG. 3 is an exploded perspective view of the receptacle connector illustrated in FIG. 2A.
Figures 4A, 4B:
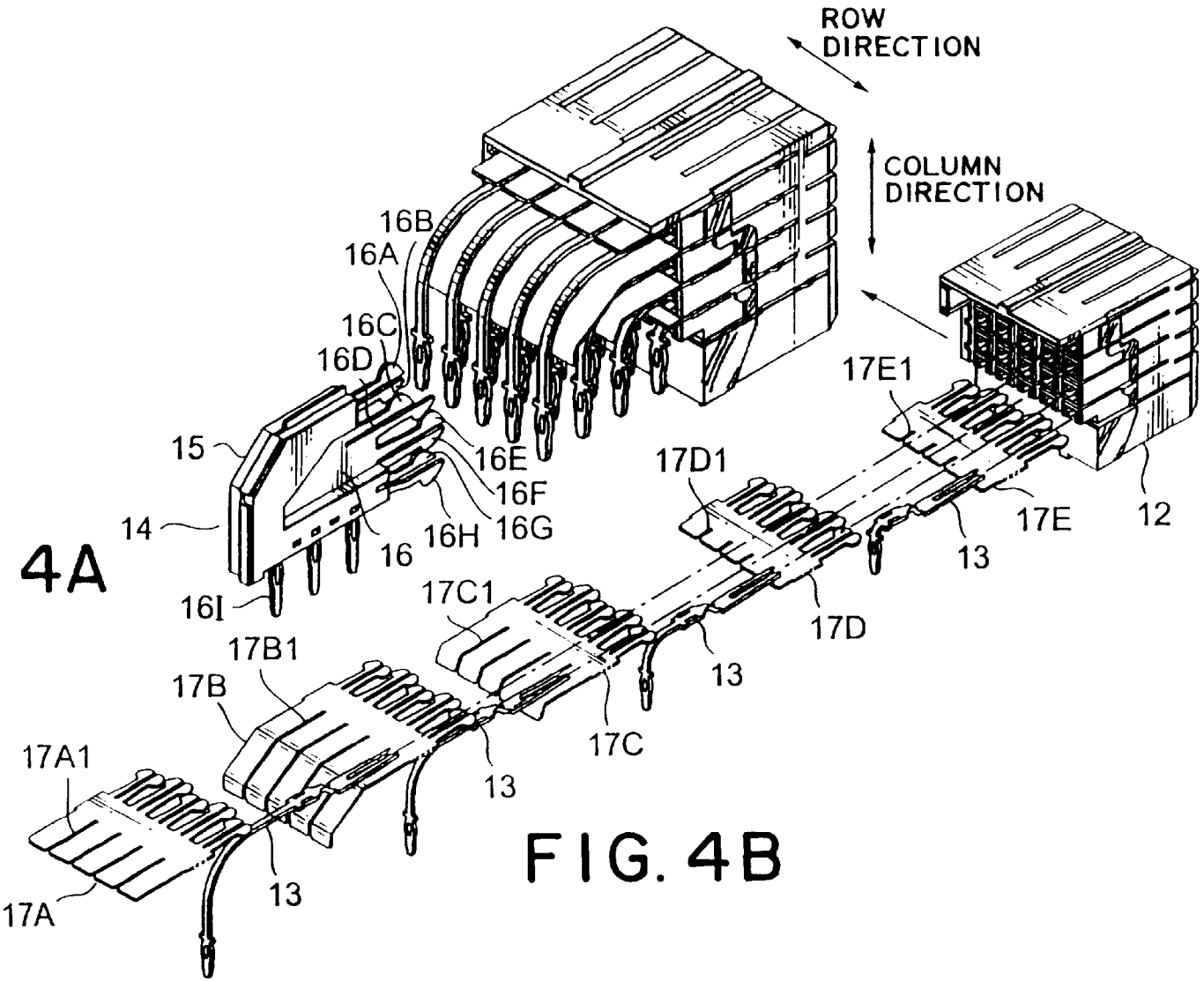
FIGS. 4A and 4B are exploded perspective views of the plug connector illustrated in FIG. 2B.

Each of the first ground plates 4 has two terminal portions 4A which are connected to a carrier 6 depicted by a two-dot-and-dash line in FIG. 3. The four pin contacts 3 in each column have terminal portions as contact lead terminals 3A, respectively, which are connected to a carrier 7 depicted by a two-dot-and-dash line in FIG. 3.

The carriers 6 and 7 are cut off after the first ground plate 4 and the contacts 3 are incorporated into the receptacle housing 2.

Each of the second ground plates 5 is provided with six contacting portions 5A formed on one side and three terminal portions (butt leads) 5B formed on the other side. The first ground plates 4 intersect with the second ground plates 5 to be perpendicular thereto and are electrically connected to the second ground plates 5 through the contacting portions 5A and the terminal portions 5B.

Each of the first ground plates 4 is press-fitted or insert-molded into the receptacle housing 2. Each of the second ground plates 5 is press-fitted into the receptacle housing 2. Then, the first and the second ground plates 4 and 5 are connected to each other.

Specifically, the first ground plates 4, six in number, and the second ground plates 5, five in number, are combined with each other to form a grid structure. Each pin contact 3 is located in each grid cell and surrounded by the first and the second ground plates 4 and 5.

Referring to FIGS. 2A–2C and 4, the plug connector 11 comprises an insulating plug housing 12, a plurality of signal socket contacts 13 held by the plug housing 12 and arranged in a matrix fashion, a plurality of ground modules 14 each of which has a first ground plate 16 extending in the column direction, and a plurality of second ground plates 17A through 17E extending in the row direction. More in detail, the socket contacts 13, twenty in number, are arranged in five columns and four rows. In other words, four socket contacts are arranged in each of the columns while five socket contacts are arranged in each of the rows. The ground modules 14, six in number, are arranged between every two adjacent ones of and at the outside of opposite outermost ones of the columns of the socket contacts 13. The second ground plates 17A through 17E, five in number, are arranged between every two adjacent ones of and at the outside of opposite outermost ones of the rows of the socket contacts 13.

Each of the ground modules 14 comprises an insulator 15 and the first ground plate 16 insert-molded into the insulator 15. The first ground plate 16 is provided with a plurality of contacting portions 16A through 16H formed at its forward end to be connected to the second ground plates 17A through 17E. The first ground plate 16 is provided with three terminals 16I formed at its lower end.

The second ground plate 17A has a plurality of slits (four of six slits are shown) 17A1 into which first ground plates 16 are inserted to be combined with the second ground plate 17A, while the second ground plates 17A is fitted and connected to the contacting portion 16A of each of the first ground plates 16. Similarly, the second ground plate 17B has a plurality of slits 17B1 into which the first ground plates 16 are fitted, and the second ground plate 17B is fitted between the contacting portions 16B and 16C to be connected thereto. The second ground plate 17C has a plurality of slits 17C1 into which the first ground plates 16 are also fitted, and the second ground plate 17C is fitted between the contacting portions 16D and 16E to be connected thereto. The second ground plate 17D has a plurality of slits 17D1 into which the first ground plates 16 are fitted, and the second ground plates 17D is fitted between the contacting portions 16F and 16G to be connected thereto. The second ground plate 17E has a plurality of slits 17E1 into which the first ground plates 16 are fitted, and the second ground plate 17E is fitted and connected to the contacting portion 16H.

Each of the second ground plates 17A through 17E is press-fitted into the plug housing 12. Each of the ground modules 14 is press-fitted into the plug housing 12. Then, the second ground plates 17A through 17E and the first ground plates 6 of the ground modules 14 are connected to each other.

Thus, the first ground plates 16, six in number, and the second ground plates 17A through 17E, five in number, are combined with each other to form a grid structure. Each socket contact 13 is located in each grid cell and surrounded by the first and the second ground plates 16 and 17.

Each of the terminal portions 16I is driven or press-fitted into a through hole formed in a circuit board (not shown) to be connected and fixed to a ground pattern on the circuit board.

When the plug connector 11 is fitted to the receptacle connector 1, the signal pin contacts 3, twenty in number, and the signal socket contacts 13, twenty in number, are connected to each other. Simultaneously, the second ground plates 17A through 17E of the plug connector 11 and the first ground plates 4 of the receptacle connector 1 are connected to each other.

In the foregoing embodiment, the contacts, twenty in number, are arranged in a 5×4 matrix arrangement. However, as will readily be understood for those skilled in the art, the numbers of the rows and the columns in the matrix arrangement may be increased or decreased as desired. In this event, the number of the ground plates will be increased or decreased correspondingly.

Next referring to FIGS. 5A to 5D, 6A to 6C, and 7A and 7B, description will be made of a second embodiment of this invention.

In this embodiment, high-speed transmission connectors are used to connect a signal circuit of a differential signal transmission system in which one information signal is transmitted as a differential signal by the use of a pair of two signal lines.

Referring to FIGS. 5A to 5D and FIGS. 6A to 6C, a plug connector 31 as one of the high-speed transmission connectors comprises a plug housing 32 made of an insulating plastic material, a plurality of signal socket contacts 33 held by the plug housing 32, a plurality of ground modules 34 each of which has a first ground plate 36 extending in a first direction or a column direction, and a second ground plate 37 extending in a second direction or a row direction perpendicular to the column direction. More in detail, the socket contacts 33, twenty in number, are arranged in five columns and four rows. In other words, four socket contacts are arranged in each of the columns while five socket contacts are arranged in each of the rows. The ground modules 34, six in number, are arranged between every two adjacent ones of and at the outside of opposite outermost ones of the columns of the socket contacts 33. The second ground plate 37 is arranged between two upper rows and two lower rows of the socket contacts 33. The plug connector 31 further comprises a plurality of insulator blocks 38, five in number, each of which covers two lower ones of the socket contacts 33 in each column to support the two lower socket contacts 33. The insulator blocks 38 also support the second ground plate 37 placed thereon.

In each column, the two upper socket contacts 33 are paired into an upper contact pair while the lower two socket contacts 33 are paired into a lower contact pair. The upper and the lower contact pairs are adapted to transmit differential signals different and independent from each other. The second ground plate 37 serves to shield the upper and the lower contact pairs from each other. Thus, the second ground plate 37 is combined with the first ground plates 36, six in number, to intersect therewith so that the upper and the lower contact pairs in the respective columns are individually partitioned by the first and the second ground plates 36 and 37. As a consequence, the contact pairs for differential signal transmission are shielded from one another.

Each of the ground modules 34 comprises an insulator 35 and the first ground plate 36 insert-molded or press-fitted into the insulator 35. The first ground plate 36 is provided with a pair of contacting portions 36A formed at its forward end to be inserted into each of a plurality of slits 37A of the second ground plate 37 to be connected thereto. The first ground plate 36 is provided with three ground terminal portions 36B formed at its lower end. Each of the ground terminal portions 36B is press-fitted into a through hole of a circuit board or a daughter board 39 to connect and fix the first ground plate 36 to a ground pattern on the daughter board 39.

The second ground plate 37 is bent into a generally L shape and has the slits 37A formed on one side and a plurality of contacting portions 37B formed on the other side to be connected to a plurality of first ground plates 24 of a receptacle connector 21 which will later be described, respectively.

Upon assembling, the second ground plate 37 is press-fitted into the plug housing 32. Each of the ground modules 34 is press-fitted into the plug housing 32. Then, the first ground plates 36 in the ground modules 34 and the second ground plate 37 are connected to each other.

Figure 5A:
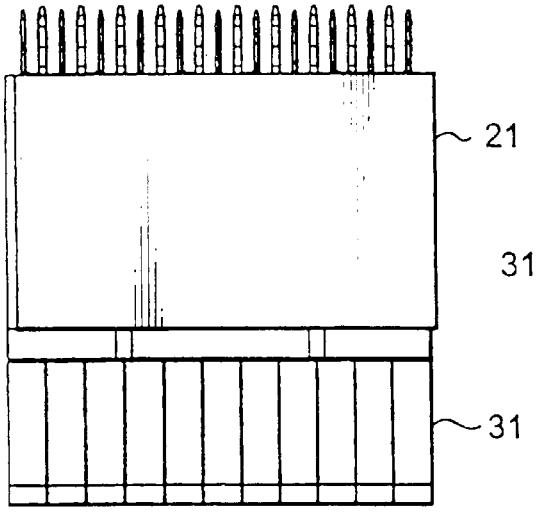
FIGS. 5A and 5B are a plan view and a front view of a receptacle connector and a plug connector as high-speed transmission connectors according to a second embodiment of this invention, respectively, when they are fitted to each other.
Figure 5B:
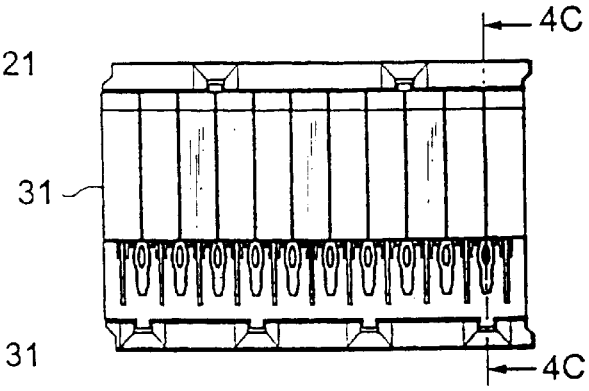
Figure 5C:
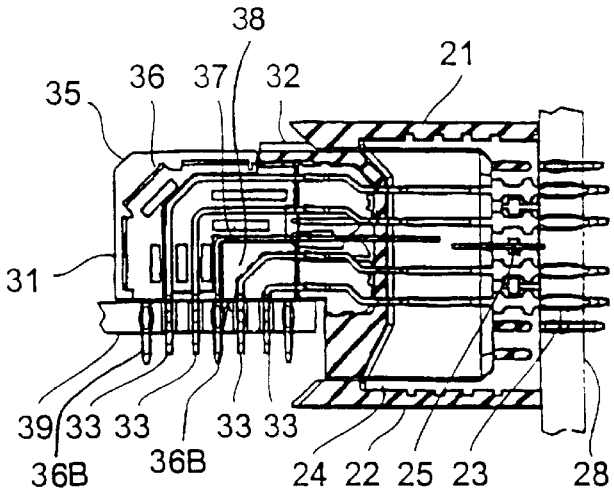
FIG. 5C is a sectional view taken along a line 5C—5C in FIG. 5B.
Figure 5D:
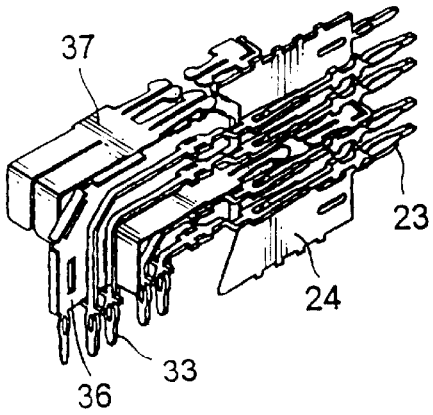
FIG. 5D is a perspective view showing contacts and a ground plate in FIG. 5C.
Figures 6A, 6B, 6C:
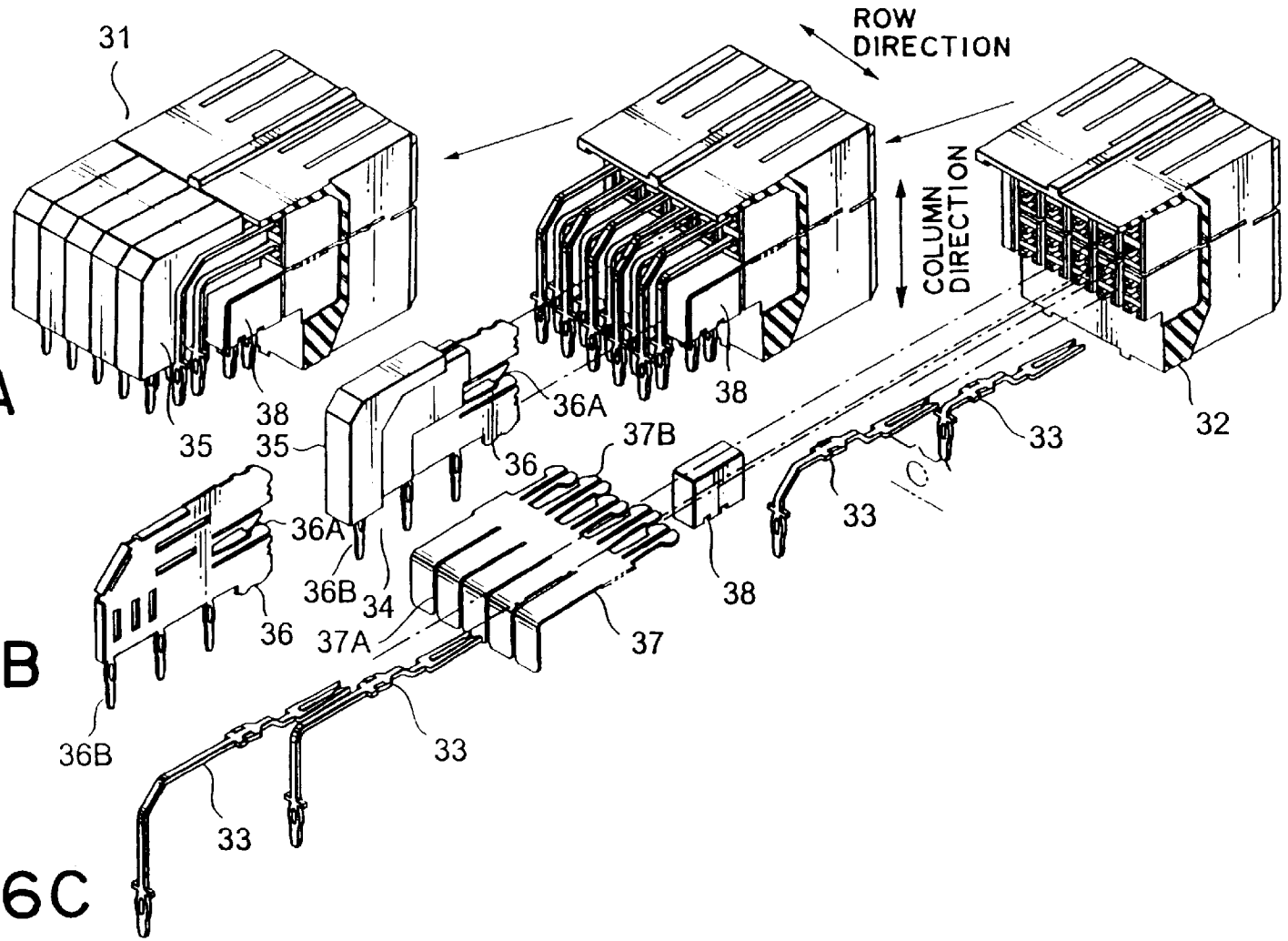
FIG. 6A is a partially-cutaway perspective view of the plug connector illustrated in FIGS. 5A through 5C.
FIGS. 6B and 6C are exploded perspective views of the plug connector illustrated in FIG. 6A.

As illustrated in FIG. 5C, each of the insulator blocks 38 holds the two lower socket contacts 33. Furthermore, the insulator blocks 38 support a lower surface of the second ground plate 37 and opposite side surfaces of the first ground plates 36.

Figures 7A, 7B:
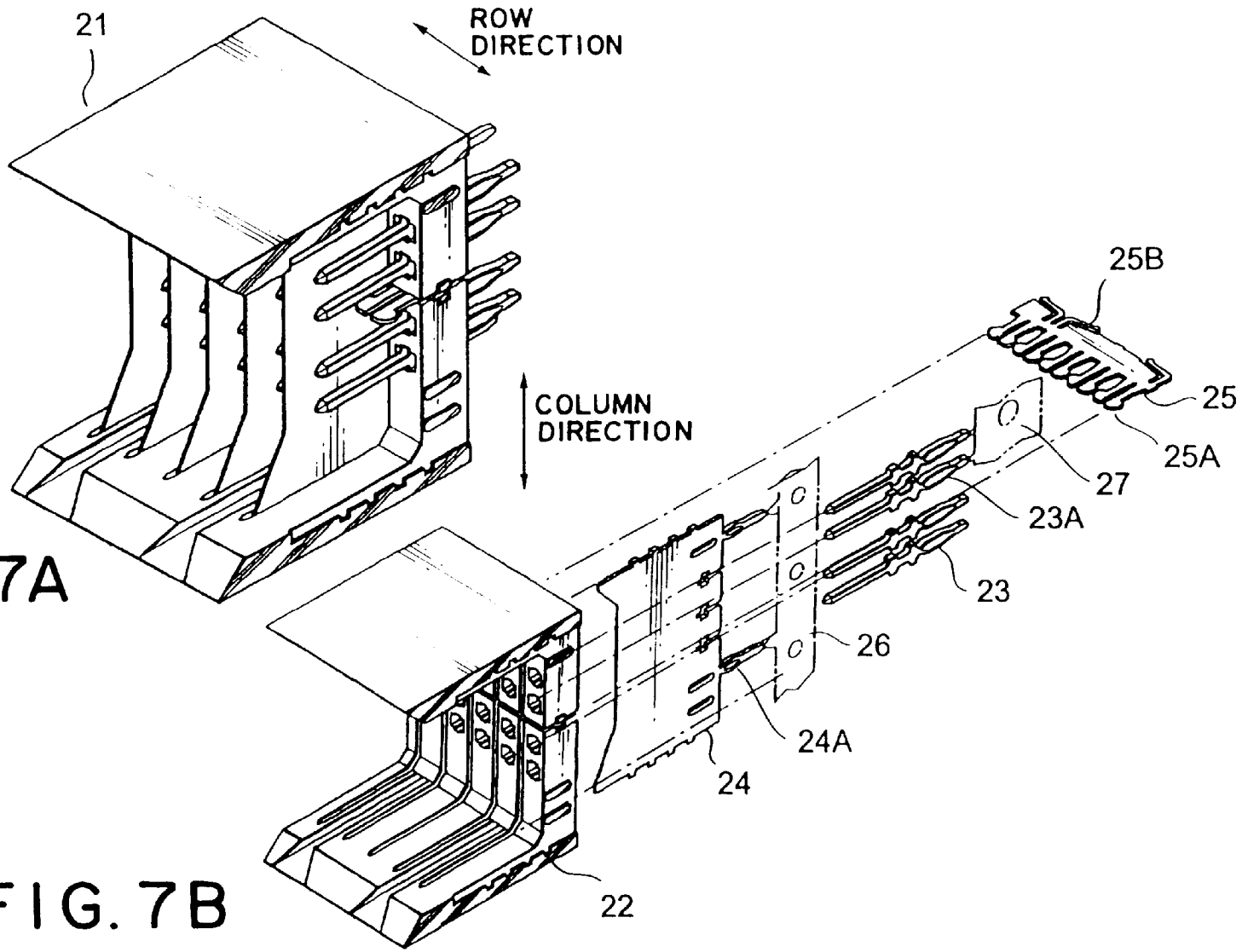
FIGS. 7A and 7B are a perspective view and an exploded perspective view of the receptacle connector illustrated in FIGS. 5A through 5C, respectively.

Referring to FIGS. 7A and 7B, the receptacle connector 21 as the other of the high-speed transmission connectors comprises a generally U-shaped receptacle housing 22, a plurality of signal pin contacts 23 held by the receptacle housing 22, a plurality of the first ground plates 24 extending in the column direction, and a second ground plate 25 extending in the row direction. More in detail, the pin contacts 23, twenty in number, are arranged in five columns and four rows. In other words, four pin contacts are arranged in each of the columns while five pin contacts are arranged in each of the rows. The first ground plates 24, six in number, are arranged between every two adjacent ones of and at the outside of opposite outermost ones of columns of the pin contacts 23. The second ground plate 25 is arranged between two upper rows and two lower rows of the pin contacts 23.

Thus, the second ground plate 25 is combined with the first ground plates 24, six in number, to intersect therewith so that upper and lower pairs of the pin contacts 23 in the respective columns are individually partitioned by the first and the second ground plates 24 and 25. As a consequence, the contact pairs for differential signal transmission are shielded from one another.

The receptacle connector 21 is mounted to a mother board 28 as a circuit board.

Each of the first ground plates 24 has two terminal portions 24A to be connected to a ground pattern on the mother board 28. The terminal portions 24A are connected to a carrier 26 depicted by a two-dot-and-dash line in FIG. 7B.

The four pin contacts 23 in each column have terminal portions 23A, respectively, to be connected to a circuit pattern on the mother board 28. The terminal portions 23A are connected to a carrier 27 depicted by a two-dot-and-dash line in FIG. 7B.

The second ground plate 25 is provided with six contacting portions 25A formed on its one side and three terminal portions 25B formed on the other side. The first ground plates 24 are connected through the contacting portions 25A to the second ground plate 25. The terminal portions 25B are to be brought into press contact with the ground pattern on the mother board 28. The terminal portions 25B may be omitted.

Each of the first ground plates 24 is press-fitted or insert-molded into the receptacle housing 22. The second ground plate 25 is press-fitted into the receptacle housing 22. Then, the first and the second ground plates 24 and 25 are connected to each other.

When the receptacle connector 21 and the plug connector 31 are fitted to each other as illustrated in FIGS. 5A through 5D, the signal pin contacts 23, twenty in number, and the signal socket contacts 33, twenty in number, are connected to each other. Simultaneously, the first ground plates 24, six in number, of the receptacle connector 21 are connected to the second ground plate 37 of the plug connector 31 through the contacting portions 37B.

In the embodiment illustrated in FIGS. 5A–5D to FIGS. 7A and 7B, the second ground plate is not arranged at the outside of the opposite outermost ones of the rows of the contacts. Since the differential signal is transmitted, signal currents flowing through the contacts are cancelled by each other so that little influence is given to the outside. Therefore, the second ground plate is arranged only between the adjacent contact pairs in order to avoid occurrence of cross talk therebetween. Thus, the connector is simplified in structure and reduced in size. If desired, however, the second ground plates may be arranged at the outside of the opposite outermost ones of the rows of the contacts.

In the foregoing embodiment, two contact pairs for differential signals are arranged in each single column. However, as will readily be understood for those skilled in the art, the number of the contact pairs may be increased as desired. In this event, the second ground plate will be added correspondingly. Furthermore, the number of columns may be increased or decreased as desired.

Next referring to FIGS. 8A–8B to 10, description will be made of high-speed transmission connectors according to a third embodiment of this invention as a modification of the second embodiment for the differential signal transmission system.

The high-speed signal transmission connectors according to the third embodiment are similar in basic structure to that of the second embodiment except that a receptacle connector does not have a second ground plate extending in a row direction and that, in a plug connector, a second ground plate extending in the row direction is integrally coupled with insulator blocks by insert-molding. Similar parts are designated by like reference numerals and description thereof will be omitted.

Figure 8B:
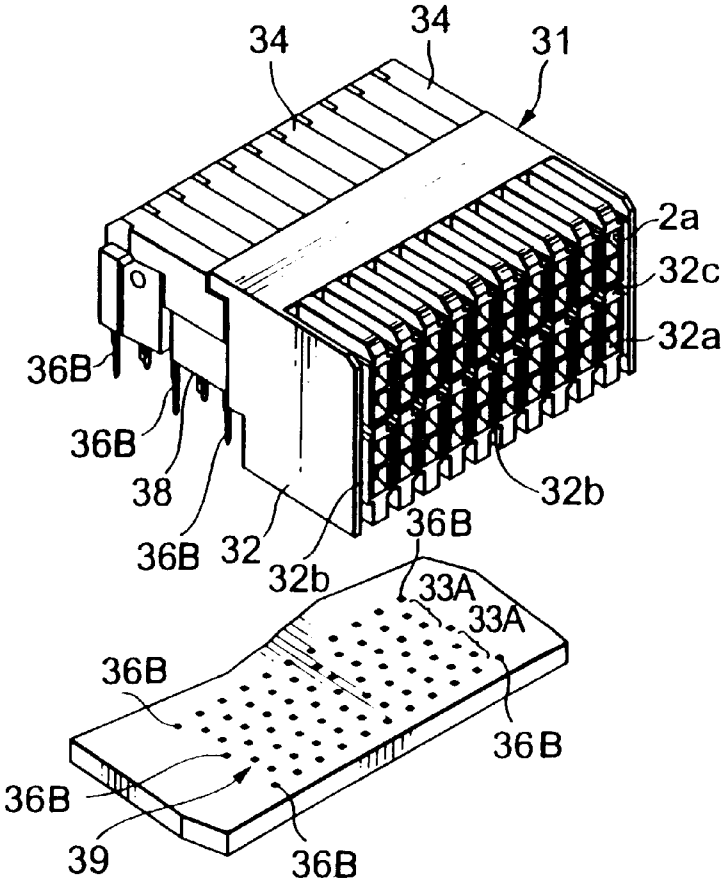
FIGS. 8A and 8B are perspective views of a receptacle connector and a plug connector as high-speed transmission connectors according to a third embodiment of this invention, respectively, when they are not fitted to each other.
Figure 8A:
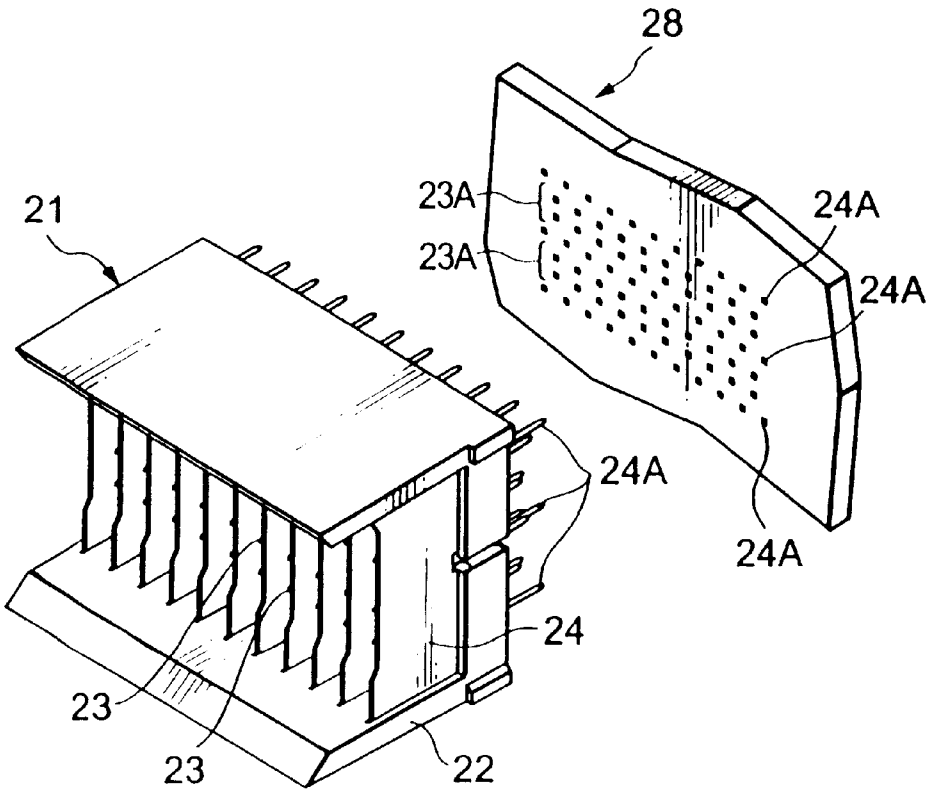

Referring to FIGS. 8A and 8B, the receptacle connector 21 and the plug connector 31 are similar in external appearance to those of the second embodiment, respectively.

A plug housing 32 of the plug connector 31 has a plurality of contact holding holes 32*a* arranged in a matrix fashion to form a plurality of columns and a plurality of rows including two upper rows and two lower rows, a plurality of first slits 32*b* formed between every two adjacent ones of and at the outside of opposite outermost ones of the columns of the contact holes 32*a* and extending in parallel to the columns, and a second slit 32*c* formed between the two upper rows and the two lower rows and extending in parallel to the rows.

A plurality of socket contacts 33 are held in the contact holding holes 32*a*, respectively, to be arranged in a matrix fashion.

A plurality of first ground plates 36 are press-fitted into the first slits 32*b* while a second ground plate 37 is press-fitted into the second slit 32*c*. Thus, the first and the second ground plates 36 and 37 are attached and fixed to the plug housing 32.

The above-mentioned structure may be applied to the plug connector in the second embodiment.

Figure 10:
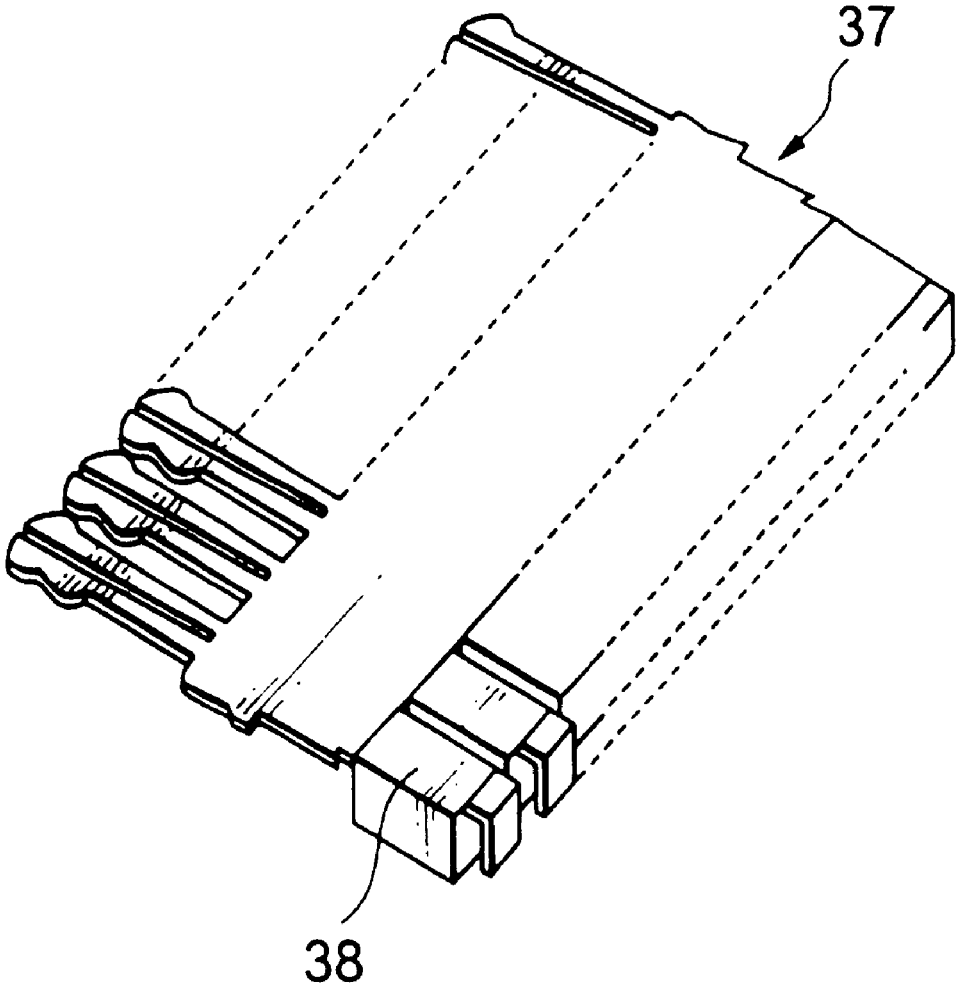
FIG. 10 is a perspective view of a second ground plate module of the plug connector illustrated in FIG. 8B.

Referring to FIG. 10, a plurality of insulator blocks 38 are integrally coupled to the second ground plate 37 by insert-molding.

The first ground plate 36 has a plurality of ground terminals 36B extending in a plane same as the ground plate 36.

In the plug connector 31 having the above-mentioned structure, terminals (contact lead terminals) 33A of the contacts 33 and the ground terminals 36B of the first ground plates 36 are arranged in correspondence to through holes formed in a daughter board 39 illustrated in FIG. 8B to receive these terminals. In the figure, the through holes are depicted by same reference numerals as these terminals.

Specifically, the three ground terminals 36B of each of the first ground plates 36 are referred to as first, second, and third ground terminals in the order from the outermost one. The contact lead terminals 33A are arranged to form a plurality of columns and a plurality of rows in a matrix arrangement. The first through the third ground terminals 36B are arranged between every two adjacent ones of and at the outside of opposite outermost ones of the columns of the contact lead terminals 33A. The first ground terminals 36B of the first ground plates 36 are arranged at the outside of the first row of the contact lead terminals 33A to be aligned in parallel to the first row. The second ground terminals 36B are arranged between the second and the third rows of the contact lead terminals 33A to be aligned in parallel to the second and the third rows. The third ground terminals 36B are arranged outside the fourth row of the contact lead terminals 33A to be aligned in parallel to the fourth row.

Figure 9B:
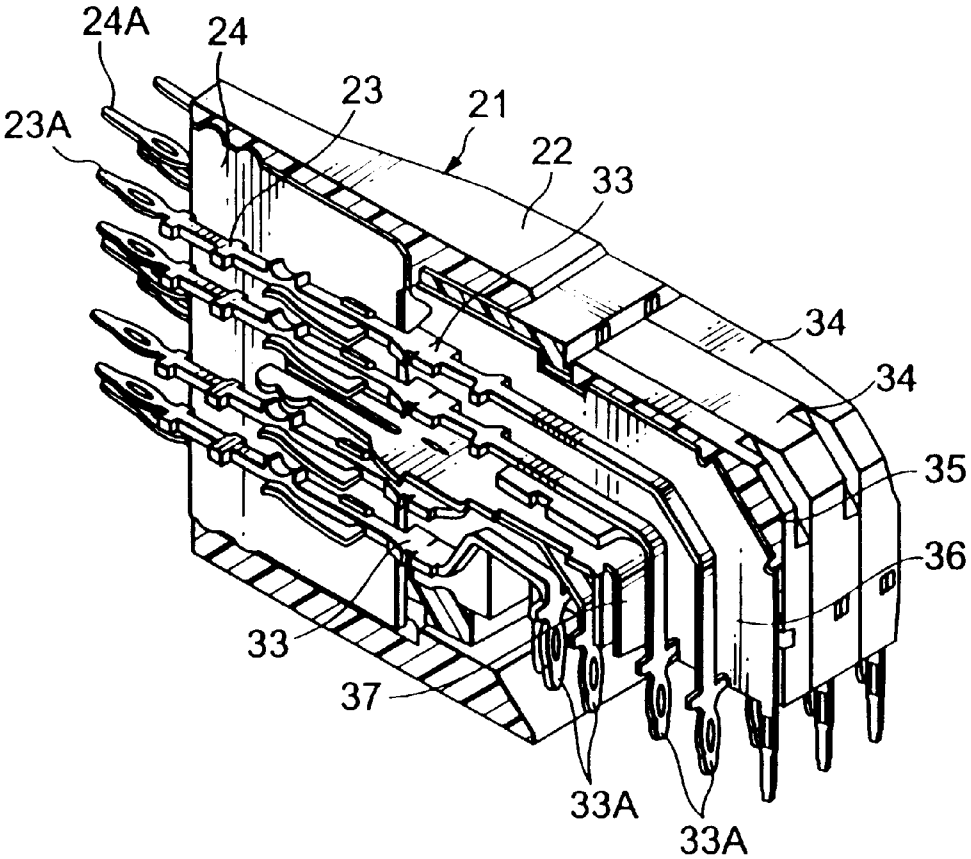
FIG. 9B is a partially-cutaway perspective view of a part of the receptacle connector and the plug connector in FIG. 9A.
Figure 9A:
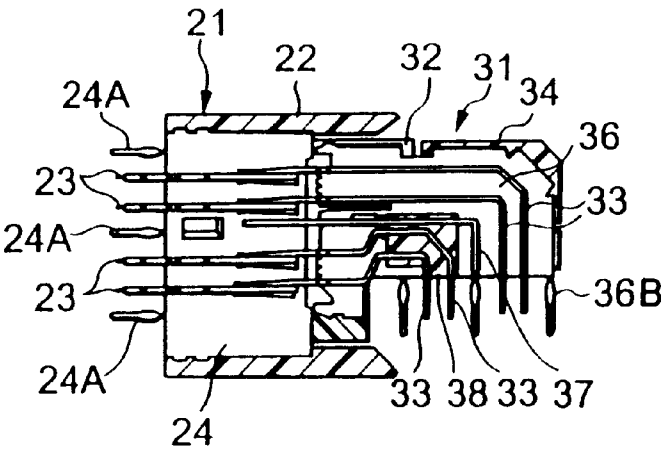
FIG. 9A is a sectional view of the receptacle connector and the plug connector illustrated in FIGS. 8A and 8B when they are fitted to each other.

As seen from FIG. 9A, the receptacle connector 21 has no second ground plate. Each of a plurality of first ground plates 24 has three ground terminals 24A extending in a plane of the first ground plate 24.

In the receptacle connector 21, terminals (contact lead terminals) 23A of a plurality of pin contacts 23 and the ground terminals 24A of the first ground plates 24 are arranged in correspondence to the through holes formed in a mother board 28 illustrated in FIG. 8A to receive these terminals. In the figure, the through holes are depicted by same reference numerals as these terminals.

Specifically, the three ground terminals 24A of each of the first ground plates 24 are referred to as first, second, and third ground terminals in the order from the uppermost one. The contact lead terminals 23A are arranged to form a plurality of columns and a plurality of rows in a matrix arrangement. The first through the third ground terminals 24A are arranged between every two adjacent ones of and at the outside of opposite outermost ones of the columns of the contact lead terminals 23A. The first ground terminals 24A of the first ground plates 24 are arranged at the outside the first row of the contact lead terminals 23A to be aligned in parallel to the first row. The second ground terminals 24A are arranged between the second and the third rows of the contact lead terminals 23A to be aligned in parallel to the second and the third rows. The third ground terminals 24A are arranged at the outside of the fourth row of the contact lead terminals 23A to be aligned in parallel to the fourth row.

Next referring to FIGS. 11A to 11B and 12A to 12B, description will be made of high-speed transmission connectors according to a fourth embodiment of this invention as a further modification of the third embodiment.

The fourth embodiment is substantially similar in structure to the third embodiment except a lead-out structure of the ground terminals. Similar parts are designated by like reference numerals and detailed description thereof will be omitted.

Figure 11B:
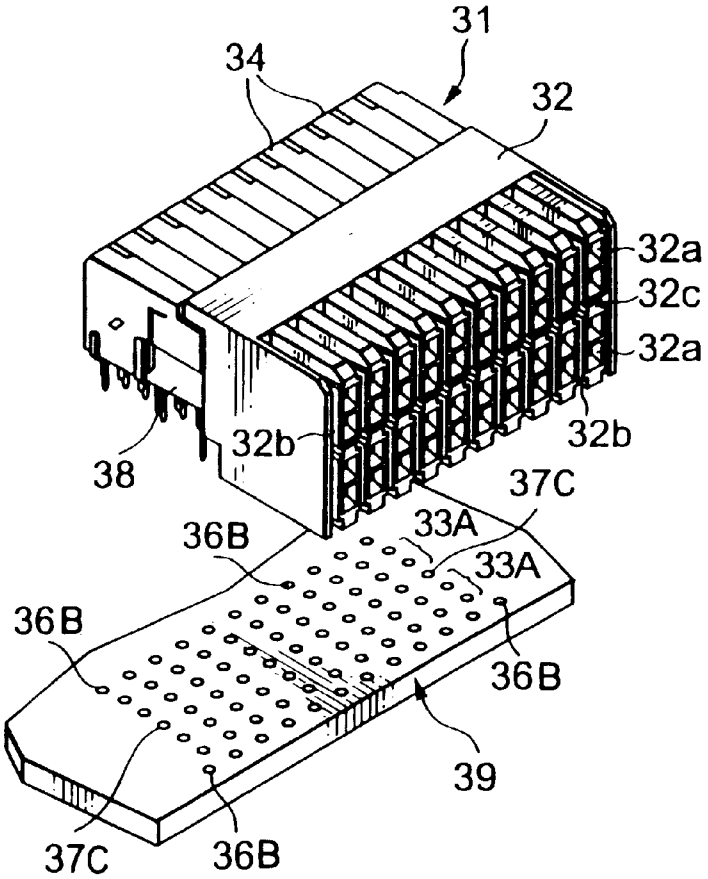
FIGS. 11A and 11B are perspective views of a receptacle connector and a plug connector as high-speed transmission connectors according to a fourth embodiment of this invention, respectively, when they are not fitted to each other.
Figure 11A:
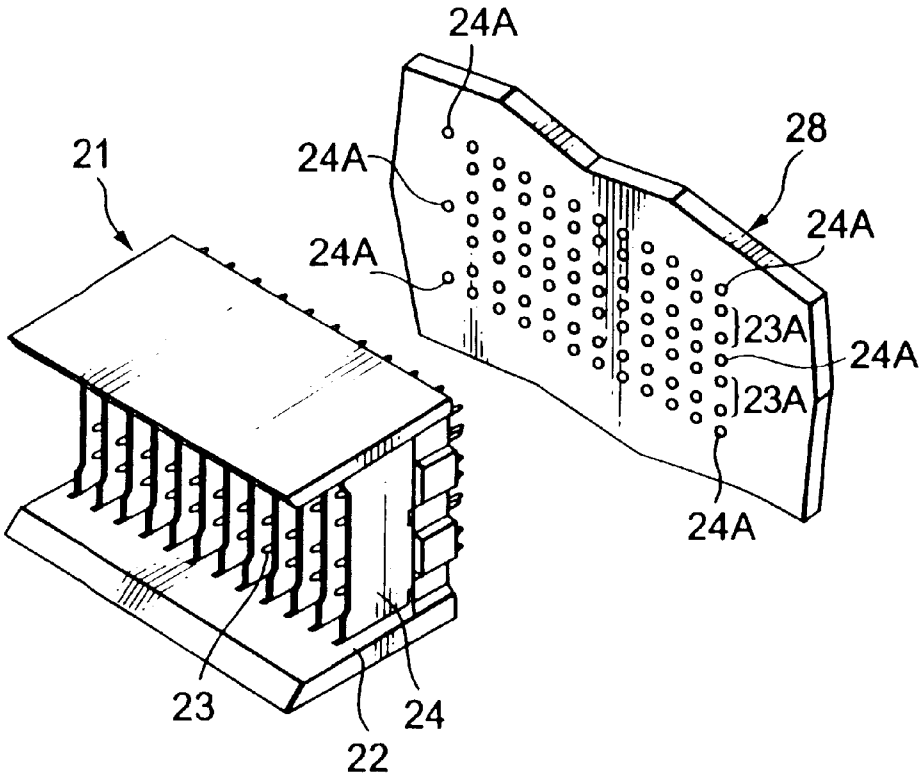

Referring to FIG. 11A, each of three ground terminals 24A of each of a plurality of first ground plates 24 of a receptacle connector 21 is connected to a bent portion formed by perpendicularly bending a part of the first ground plate 24 and extends in parallel to a plane of the bent portion and a plane of the first ground plate 24. The ground terminals 24A are arranged to be aligned in the columns of contact terminals 23A of a plurality of pin contacts 23.

In the receptacle connector 21, the terminals (contact lead terminals) 23A of the pin contacts 23 and the ground terminals 24A of the first ground plates 24 are arranged in correspondence to the through holes formed in a mother board 28 illustrated in FIG. 11A to receive these terminals. In the figure, the through holes are depicted by same reference numerals as these terminals.

Specifically, the three ground terminals 24A of each of the first ground plates 24 are referred to as first, second, and third ground terminals in the order from the uppermost one. The contact lead terminals 23A and the first and the second ground terminals 24A are arranged to form a plurality of columns and a plurality of rows in a matrix arrangement. The first ground terminals 24A of the first ground plates 24 are arranged at the outside of the first row of the contact lead terminals 23A to be aligned in parallel to the first row. The second ground terminals 24A are arranged between the second and the third rows of the contact lead terminals 23A to be aligned in parallel to the second and the third rows. The third ground terminals 24A are arranged at the outside the fourth row of the contact lead terminals 23A to be aligned in parallel to the fourth row.

The three ground terminals 24A of the outermost one of the first ground plates 24 are aligned in a single column which does not contain any contact lead terminal.

Figure 12B:
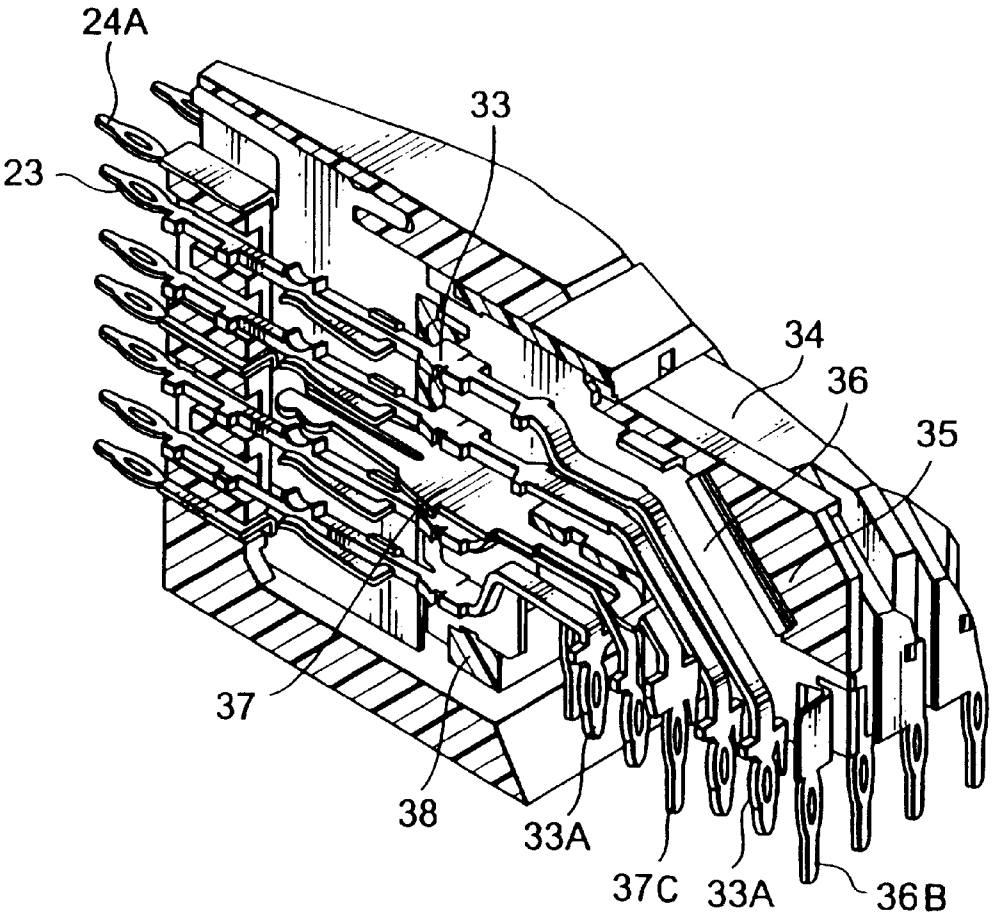
FIG. 12B is a partially-cutaway perspective view of a part of the receptacle connector and the plug connector illustrated in FIG. 12A.
Figure 12A:
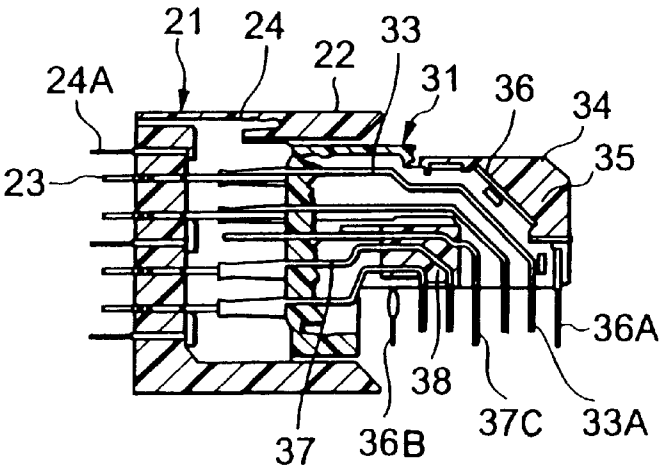
FIG. 12A is a sectional view of the receptacle connector and the plug connector illustrated in FIGS. 11A and 11B when they are fitted to each other.
Figure 13:
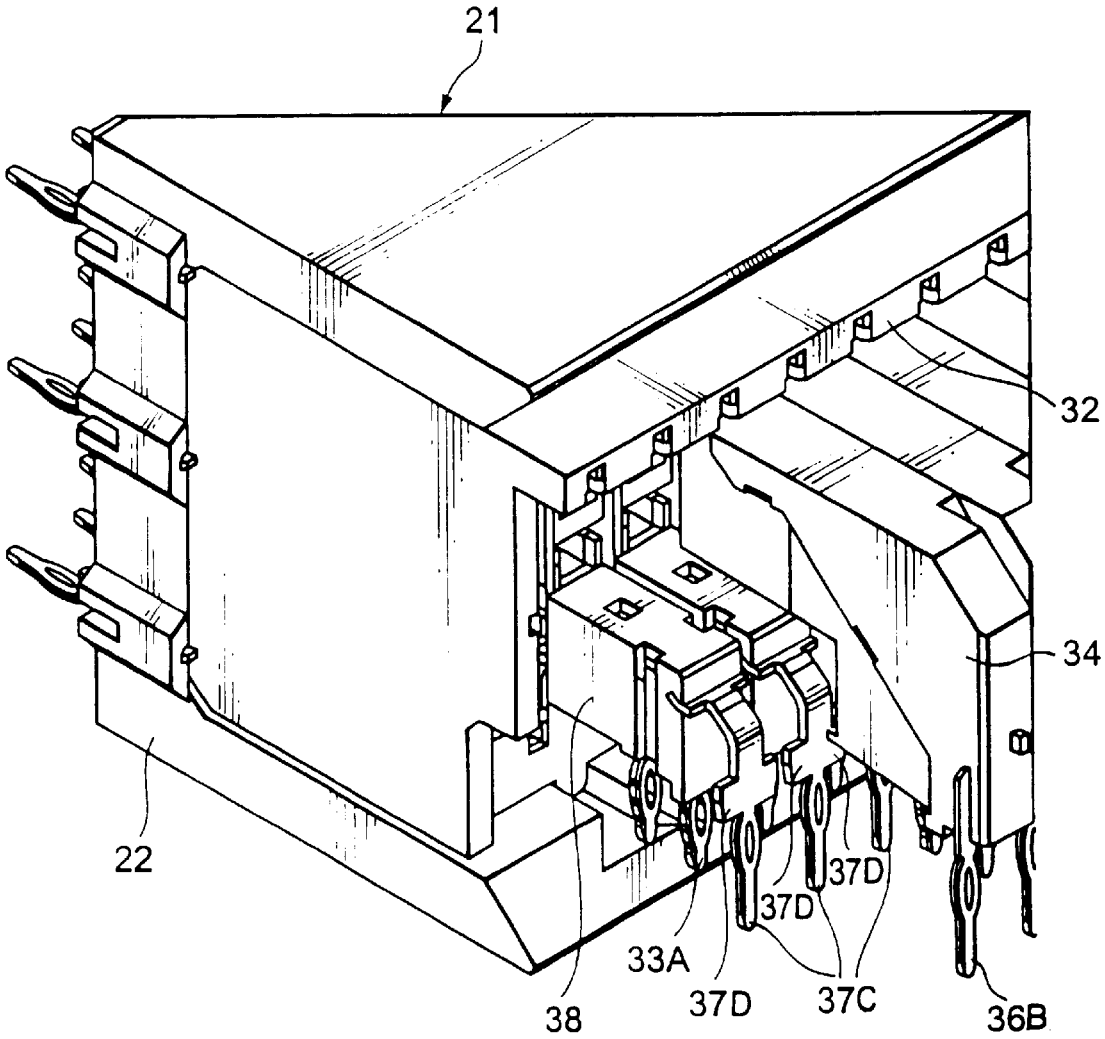
FIG. 13 is a partially cutaway perspective view for describing an internal structure of the plug connector illustrated in FIGS. 11B.

Referring to FIG. 12B and 13, each of a plurality of first ground plates 36 of a plug connector 31 has two ground terminals 36B as first and second ground terminals in the order from the outermost one. A middle one of three ground terminals of each of first ground plates in the foregoing embodiments is omitted in the present embodiment. Instead of the middle one, a ground contact is provided, as a third ground terminal, to a second ground plate 37. Thus, the second ground plate 37 is provided with a plurality of third ground terminals 37C corresponding to the first ground plates, respectively.

The first or outermost ground terminal 36B of the first ground plate 36 is connected to a bent portion formed by perpendicularly bending a part of the first ground plate 36 and extends in parallel to a plane of the bent portion and a plane of the first ground plate 36. As a consequence, the first ground terminal 36B is aligned with one of adjacent columns of the contact terminals 33A and one of the third ground terminal 37C of the second ground plate 37.

In the plug connector 31, the first and the second ground terminals 36B, the third ground terminals 37C, and contact lead terminals 33A are arranged in correspondence to through holes formed in a daughter board 39 illustrated in FIG. 11B. In the figure, the through holes are depicted by same reference numerals as these terminals.

Specifically, the contact lead terminals 33A, the first ground terminals 36B, and the third ground terminals 37C are arranged to form a plurality of columns and a plurality of rows in a matrix arrangement. The first ground terminals 36B of the first ground plates 36 are arranged at the outside of the first row of the contact lead terminals 33A to be aligned in parallel to the first row. The third ground terminals 37C of the second ground plate 37 are arranged between the second and the third rows of the contact lead terminals 33A to be aligned in parallel to the second and the third rows. The second ground terminals 36B of the first ground plates 36 are arranged at the outside of the fourth row of the contact lead terminals 33A to be aligned in parallel to the fourth row and at positions shifted from the respective columns of the contact lead terminals 33A.

As is obvious from FIG. 13, each of the third ground terminals 37C is provided with a pair of wing portions 37D formed at its base to protrude on opposite sides. On the wing portions 37D, the insulator 35 of an adjacent one of a plurality of ground modules 34 is placed. As a consequence, by pressing the ground module 34 upon mounting the plug connector 31 to the daughter board 39, the third ground terminals 37C as well as the first and the second ground terminals 36B are press-fitted into the through holes corresponding thereto.

As is obvious from the foregoing description, this invention is advantageous in the following respects.

The ground plates are arranged in the grid structure to surround each individual contact or each individual contact pair. Therefore, it is possible to provide a high-speed transmission connector capable of transmitting a high-speed signal and having excellent cross talk characteristics.

The connector is simple in structure, small in number of parts, and easy in assembling and disassembling.

What is claimed is:

1. A high-speed transmission connector comprising an insulating connector housing, a plurality of contacts fixed to said connector housing at positions forming a plurality of rows and a plurality of columns in a matrix arrangements, and a shield attached to said connector housing, wherein:

said shield comprises a plurality of first ground plates extending in parallel to the columns of said contacts and a plurality of second ground plates extending in parallel to the rows of said contacts;

at least either one ground plates of said first ground plates and said second ground plates being provided with contacting portions to be connected to the other ground plates, one of each of said first ground plates and each of said second ground plates having at least one ground terminal to be connected to an external circuit;

said first ground plates being arranged at an outside of opposite outermost ones of and between every two adjacent ones of the columns of said contacts, said second ground plates being arranged at the outside of opposite outermost ones of and between every two adjacent one of the rows of said contacts, said first and second ground plates surrounding said contacts and forming a grid structure.

2. A high-speed transmission connector as described in claim 1, wherein said connector is a plug connector in which each of said contacts has a socket contact portion to be brought into contact with a pin contact of a mating connector.

3. A high-speed transmission connector as described in claim 1, wherein said connector is a receptacle connector in which each of said contacts has a pin contact portion to be brought into contact with a socket contact of a mating connector.

4. A high-speed transmission connector as described in claim 1, wherein said connector is a board connector to be mounted on a circuit board, each of said contacts having a contact lead terminal to be connected to a circuit pattern on said circuit board, said at least one ground terminal being connected to a ground pattern on said circuit board.

5. A high-speed transmission connector as described in claim 4, wherein said circuit board has a through hole in said ground pattern, said ground terminal being a press-fit terminal to be press-fitted into said through hole.

6. A high-speed transmission connector as described in claim 4, wherein said contact lead terminals are arranged to form a plurality of columns and a plurality of rows in a matrix arrangement, a plurality of said ground terminals being formed in each of said first ground plates, said ground terminals being arranged between every two adjacent ones of the columns of said contact lead terminals and between every two adjacent ones of the rows of said contact lead terminals.

7. A high-speed transmission connector as described in claim 6, wherein each of said second ground plates has a contacting portion to be brought into contact with a shield of a mating connector.

8. A high-speed transmission connector as described in claim 6, wherein each of said first ground plates is integrally coupled with an insulator by press-fitting or insert-molding to form a ground plate module, said ground plate modules being inserted in said connector hosing at the outside of opposite outermost ones of and between every two adjacent ones of the columns of said contacts to be incorporated into said connector housing.

9. A high-speed transmission connector as described in claim 8, wherein each of said contact lead terminals of said contacts and said ground terminals of said first ground plates is formed into a press-fit portion, said ground plate modules being pressed onto said circuit board to thereby press-fit said press-fit portion to said circuit board to attach said connector to said circuit board.

10. A high-speed transmission connector as described in any one of claims 1 through 9, said high-speed transmission connector being for use in connecting a signal circuit of a differential signal transmission system in which a single differential signal is transmitted through each pair of two adjacent ones of said contacts, wherein each pair of two adjacent ones of said contacts are surrounded by said first and said second ground plates.

11. A high-speed transmission connector for use in connecting a signal circuit of a differential signal transmission system in which a single differential signal is transmitted through each pair of two adjacent ones of a plurality of contacts, and wherein said connector is a board connector to be mounted on a circuit board, said connector comprising:

an insulating connector housing provided with a plurality of contact holding holes arranged in a matrix fashion to form a plurality of columns and a plurality of rows including two upper rows and two lower rows, a plurality of first slits formed between every two adjacent ones of and at an outside of opposite outermost ones of the columns of said holding holes and extending in parallel to the columns, and a second slit formed between the two upper rows and the two lower rows of said holding holes and extending in parallel to the rows;

a plurality of contacts fixed to said contact holding holes, respectively;

a plurality of first ground plates inserted into said first slits, respectively; and a second ground plate inserted into said second slit and brought into contact with said first ground plates;

each of said contacts having a contact lead terminal to be connected to a circuit pattern on said circuit board, each of said first ground plates having first, second, and third ground terminals to be connected to a ground pattern on said circuit board, said contact lead terminals being arranged to form a plurality of columns and a plurality of rows in a matrix arrangement, said first, said second, and third ground terminals being arranged at the outside of opposite outermost ones of and between every two adjacent ones of the columns of said contact lead terminals in a direction parallel to the columns, said first ground terminals of said first ground plates being arranged at an outside of the first row of said contact lead terminals in parallel to the first row, said second ground terminals being arranged between second and third rows of said contact lead terminals in parallel to the second and the third rows, said third ground terminals being arranged at an outside of a fourth row of said contact lead terminals in parallel to the fourth row.

12. A high-speed transmission connector as described in paragraph 11, wherein the second ground plate has, an insulating block formed at its rear end and a plurality of slits for receiving the first ground plates.

13. A high-speed transmission connector as described in claim 12, wherein each of said first ground plates is integrally coupled with an insulator by press-fitting or insert-molding to form a ground plate module, said ground plate modules being inserted said connector housing at outside of the opposite outermost ones of and between every two adjacent ones of the columns of said contacts to be incorporated into said connector housing.

14. A high-speed transmission connector as described in claim 13, wherein each of said contact lead terminals of said contacts and said ground terminals of said first ground plates is formed into a press-fit portion, said ground plate modules being pressed onto said circuit board to thereby press-fit said press-fit portion to said circuit board to attach said connector to said circuit board.

15. A high-speed transmission connector as described in claim 11, wherein said connector is a board connector to be mounted on a circuit board, each of said contacts having a contact lead terminal to be connected to a circuit pattern on said circuit board, each of said first ground plates having first and second ground terminals to be connected to a ground pattern on said circuit board, said second ground plate having a plurality of third ground terminals to be connected to a ground pattern on said circuit board, said contact lead terminals and said first and said third ground terminals being arranged to form a plurality of columns and a plurality of rows in a matrix arrangement, said first ground terminals of said first ground plates being arranged at the outside the first row of said contact lead terminals in parallel to the first row, said third ground terminals of said second ground plate being arranged between the second and the third rows of said contact lead terminals in parallel to the second and the third rows, said second ground terminals of said first ground plates being arranged at the outside of the fourth row of said contact lead terminals in parallel to the fourth row and at positions shifted from the columns of said contact lead terminals.

16. A high-speed transmission connector as described in claim 15, wherein each of said third ground terminals of said second ground plate is provided with a pair of wing portions formed at its base to protrude towards adjacent columns of said contact lead terminals on opposite sides, each of said contact lead terminals of said contacts and said ground terminals of said first ground plates being formed into a press-fit portion, each of said first ground plates being integrally coupled with an insulator by press-fitting or insert-molding to form a ground plate module, said ground plate modules being inserted into said connector housing at the outside of the opposite outermost ones of and between every two adjacent ones of the columns of said contacts, said connector being attached to said circuit board by incorporating said ground plate modules into said connector housing in a state where lower ends of said insulators of said ground plate modules are brought into contact with upper ends of said wing portions and then pressing said ground plate modules to said circuit board.

17. A high-speed transmission connector as described in claim 15, wherein said second ground plate has an insulating block formed at its rear end and a plurality of slits for receiving said first ground plates.

18. A high-speed transmission connector as described in claim 17, wherein each of said first ground plates is integrally coupled with an insulator by press-fitting or insert-molding to form a ground plate module, said ground plate modules being inserted in said connector housing at the outside of opposite outermost ones of and between every two adjacent ones of the columns of said contacts to be incorporated into said connector housing.

19. A high-speed transmission connector as described in claim 18, wherein each of said contact lead terminals of said contacts and said ground terminals of said first ground plates is formed into a press-fit portion, said ground plate modules being pressed to said circuit board to thereby press fit said press-fit portion to said circuit board to attach said connector to said circuit board.

20. A high-speed transmission connector for use in connecting a signal circuit of a differential signal transmission system in which a single differential signal is transmitted through each pair of two adjacent ones of a plurality of contacts, said connector comprising:

an insulating connector housing having a plurality of contact holding holes arranged in a matrix fashion to form a plurality of columns and a plurality of rows including two upper rows and two lower rows, a plurality of first slits formed between every two adjacent ones of and at an outside of opposite outermost ones of the columns of said holding holes and extending in parallel to the columns, and a second slit formed between the two upper rows and the two lower rows of said holding holes and extending in parallel to the rows;

a plurality of contacts fixed to said contact holding holes, respectively;

a plurality of first ground plates inserted into said first slits, respectively; and a second ground plate inserted into said second slit and brought into contact with said first ground plates;

wherein each of a plurality of third ground terminals of said second ground plate has a pair of wing portions formed at its base to protrude towards adjacent columns of contact lead terminals on opposite sides, each of said contact lead terminals of said contacts and said ground terminals of said first ground plates being formed into a press-fit portion, each of said first ground plates being integrally coupled with an insulator by press-fitting or insert-molding to form a ground plate module, said ground plate modules being inserted into said connector housing at the outside of the opposite outermost ones of and between every two adjacent ones of the columns of said contacts, said connector being attached to a circuit board by incorporating said ground plate modules into said connector housing in a state where lower ends of said insulators of said ground plate modules are brought into contact with upper ends of said wing portions and then pressing said ground plate modules to said circuit board.

21. A high-speed transmission connector as described in claim 20, wherein said connector is a board connector to be mounted on a circuit board, each of said second contacts having a contact terminal to be connected to a circuit pattern on said circuit board, each of said third ground plates having fourth, fifth, and sixth ground terminals to be connected to a ground pattern on said circuit board, said contact terminals being arranged to form a plurality of columns and a plurality of rows in a matrix arrangement, said fourth, said fifth, and said sixth ground terminals being arranged at the outside of opposite outermost ones of and between every two adjacent ones of the columns of said contact terminals in a direction parallel to the columns, said fourth ground terminals of said third ground plates being arranged at the outside of the first row of said contact terminals in parallel to the first row, the fifth ground terminals being arranged between the second and the third rows of said contact terminals in parallel to the second and the third rows, said sixth ground terminals being arranged at the outside of the fourth row of said contact terminals in parallel to the fourth row.

22. A high-speed transmission connector as described in claim 20, wherein said connector is a board connector to be mounted on a circuit board, each of said second contacts having a contact terminal to be connected to a circuit pattern on said circuit board, each of said third ground plates having fourth, fifth, and sixth ground terminals to be connected to a ground pattern on said circuit board, said contact terminals and said fourth, said fifth, and said sixth ground terminals of said third ground plates except an outermost one of said third ground plates on one side being arranged to form a plurality of columns and a plurality of rows in a matrix arrangement, said fourth ground terminals of said third ground plates being arranged at the outside of the first row of said contact terminals in parallel to the first row, said fifth ground terminals being arranged between the second and the third rows of said contact terminals in parallel to the second and the third rows, said sixth ground terminals being arranged at the outside of the fourth row of said contact terminals in parallel to the fourth row, said fourth, said fifth, said sixth ground terminals of the outermost one of said third ground plates being arranged at the outside of an outermost one of the columns of said contact terminals on the one side in parallel to the outermost column.

23. A high-speed transmission connector as described in claim 20, wherein said connector is a receptacle connector in which each of said contacts has a pin contact portion to be connected to a socket portion of said first contact of said mating connector.

* * * * *

UNITED STATES PATENT AND TRADEMARK OFFICE

CERTIFICATE OF CORRECTION

PATENT NO. : 6,712,646 B2
DATED : March 30, 2004
INVENTOR(S) : Takeshi Shindo

It is certified that error appears in the above-identified patent and that said Letters Patent is hereby corrected as shown below:

Title page,
Item [22], Filing Date, delete "Nov. 19, 2001" and insert -- Oct. 19, 2001 --
Item [56], References Cited, U.S. PATENT DOCUMENTS, delete "4/1930" and insert -- 4/2002 --
FOREIGN PATENT DOCUMENTS, delete "3-142124" and insert -- 7-142124 --; insert -- JP 9-167662 6/1997 --

Signed and Sealed this

Twenty-ninth Day of June, 2004

JON W. DUDAS
*Acting Director of the United States Patent and Trademark Office*